US008968167B1

(12) United States Patent
Abelbeck et al.

(10) Patent No.: US 8,968,167 B1
(45) Date of Patent: Mar. 3, 2015

(54) RESISTANCE SYSTEM FOR AN EXERCISE DEVICE

(75) Inventors: Kevin G. Abelbeck, Fort Collins, CO (US); Brad Olschansky, Marietta, GA (US)

(73) Assignee: Exersmart, LLC, Marietta, GA (US)

( * ) Notice: Subject to any disclaimer, the term of this patent is extended or adjusted under 35 U.S.C. 154(b) by 221 days.

(21) Appl. No.: 13/342,570

(22) Filed: Jan. 3, 2012

Related U.S. Application Data

(60) Provisional application No. 61/429,910, filed on Jan. 5, 2011.

(51) Int. Cl.
*A63B 21/04* (2006.01)
*A63B 21/00* (2006.01)

(52) U.S. Cl.
USPC ..... 482/129; 482/130; 482/92

(58) Field of Classification Search
CPC .... A63B 21/0552; A63B 21/05; A63B 21/04; A63B 21/0557
USPC ..... 482/121, 94–46, 129–133, 92–96
See application file for complete search history.

(56) References Cited

U.S. PATENT DOCUMENTS

| | | | | |
|---|---|---|---|---|
| 5,039,092 | A * | 8/1991 | Olschansky et al. | 482/130 |
| 5,074,551 | A * | 12/1991 | Olschansky et al. | 482/137 |
| 7,252,627 | B2 | 8/2007 | Carter | |
| 7,335,139 | B2 | 2/2008 | Bartholomew et al. | |
| 7,413,532 | B1 | 8/2008 | Monsrud et al. | |
| 7,597,653 | B1 * | 10/2009 | Lindemeier | 482/129 |
| 7,887,468 | B2 * | 2/2011 | Ross et al. | 482/92 |
| 8,475,346 | B2 * | 7/2013 | Gerschefske et al. | 482/129 |
| 2008/0318740 | A1 * | 12/2008 | Ross et al. | 482/92 |
| 2009/0023561 | A1 * | 1/2009 | Ross et al. | 482/92 |
| 2010/0130338 | A1 * | 5/2010 | Wehrell | 482/124 |

* cited by examiner

*Primary Examiner* — Oren Ginsberg
*Assistant Examiner* — Megan Anderson
(74) *Attorney, Agent, or Firm* — Rosenberg, Klein & Lee

(57) ABSTRACT

A resistance system for an exercise device includes a plurality of cord plates which may be selectively engaged by one or more pins which may include an engagement lock. One or more of the cord plates may be received by a pin with each cord plate that is received by a pin being secured relative to a frame. A cord plate that has received a pin is engaged and a cord plate that is not received by a pin is disengaged. A carriage may be provided which receives a plurality of elastic cords which may be attached to the cord plates. The carriage may be displaced relative to a base frame, to provide elongation of the elastic cords coupled to engaged cord plates and no elongation of the cords coupled to the disengaged cord plates which provide a selective resistance for a user.

19 Claims, 9 Drawing Sheets

RESISTANCE SYSTEM FOR AN EXERCISE DEVICE

CROSS-REFERENCE TO RELATED APPLICATION DATA

Priority is claimed under 35 U.S.C. §119(e) to U.S. Provisional Application No. 61/429,910, filed on Jan. 5, 2011, which is incorporated by reference herein.

FIELD OF THE INVENTION

The present invention generally relates to exercise devices and, more particularly, to resistance systems used in exercise devices.

BACKGROUND OF THE INVENTION

A critical component of exercise devices used to increase the strength of the user, may be devices used to provide a variation in resistance. As some individuals are stronger than others, it may be useful to be able to vary the resistance from user to user, or of the same user over time to adapt to increases in strength. To develop strength, the muscle may be forced to move under tension. This tension may be provided by weights or hydraulics. Low inertia systems may also be used. These may include springs or other elastic components, or compressed air as forms of resistance. One advantage to low inertia systems, is high-speed work may be done without the interference provided by high mass of the resistance.

Regardless of the type of resistance used, the ability to change resistance may be considered a critical element to successful strength training. As a user becomes stronger, that user will desire a greater resistance. In addition, no two users are exactly the same in their strength potentials. Therefore, it may be desirable to have a system which allows for a great deal of variability in the resistance. It may also be desirable to be able to change the resistance easily. For some people changing heavy weight plates may be difficult or even impossible depending upon that person's strength. Particularly in any rehabilitation setting, it may be desirable to be able to change resistance with minimal effort. A system that includes rotating one or more knobs may require much less physical exertion to change the resistance as compared to lifting heavy weights to add or remove from a bar or other apparatus. If a user has limited physical ability and cannot change the resistance easily, that may preclude them from using the exercise device altogether. No exercise device is of any value if it is not used.

SUMMARY OF THE INVENTION

The present invention is a resistance system for exercise which may include a frame, at least two resistance elements which are operationally unique from one another and an engagement lock with a main shaft pivotally mounted to the frame and at least two pins positioned substantially radially equidistant from the main shaft. The pin of the at least two pins, may be selectively engaged with one of the resistance elements of the at least two resistance elements without engaging the second resistance element. Thereby, each resistance element is unique in that engaging one resistance element does not result in the engagement of another resistance element by its position or orientation. The device may also include a user interface adapted to enable a user to apply a force thereto, the user interface may be in communication with one or more of the at least two resistance elements, whereby any of at least two resistance elements may be engaged by any of the at least two pins. The engaged resistance element may provide resistance to movement of the user interface relative to the frame. This user interface may be a handle with a cable attached, a bar with cables attached or an arm, freely or pivotally mounted to the frame.

The at least two resistance elements may be comprised of elastic cords coupled to a carriage and supported to allow for movement relative to the frame. The carriage may include a plate guide adapted to support any resistance elements not engaged by any of the at least two pins. The device may also include a drive cam coupled to a carriage, the carriage supporting the at least two resistance elements. The drive cam may be pivotally coupled to the frame and provide a variable moment arm to the carriage as the cam rotates relative to the frame.

The frame may include a base frame with pulley mounts and a platform adapted to support a user. A rotational pulley may also be mounted to the frame. The axis of rotation of the rotational pulley mount may be substantially collinear with the axis of a cable guided by a pulley mounted in the rotational pulley mount. In addition, the device may include two engagement locks, each with a main shaft pivotally mounted to the frame and at least two pins positioned substantially radially equidistant from the main shaft.

For purposes of summarizing the invention and the advantages achieved over the prior art, certain advantages of the invention have been described herein above. Of course, it is to be understood that not necessarily all such advantages can be achieved in accordance with any particular embodiment of the invention. Thus, for example, those skilled in the art will recognize that the invention can be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following description of the preferred embodiments and drawings, the invention not being limited to any particular preferred embodiment (s) disclosed.

BRIEF DESCRIPTION OF THE DRAWINGS

Embodiments of the present invention will now be described, by way of example only, with reference to the following drawings, in which.

DETAILED DESCRIPTION OF THE INVENTION

Figure 1:
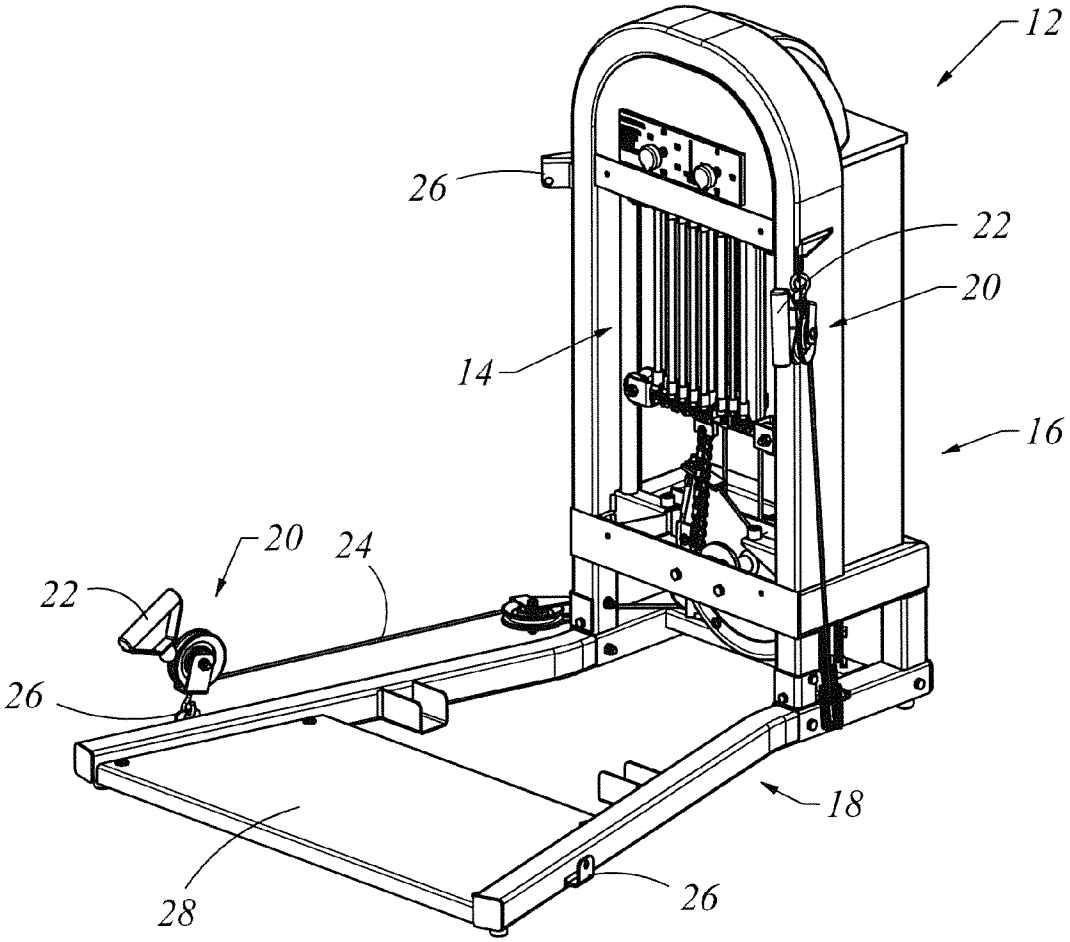
FIG. 1 is an isometric right side view of a resistance system in an exercise device incorporating a selection system in accordance with the present invention.
Figure 2:
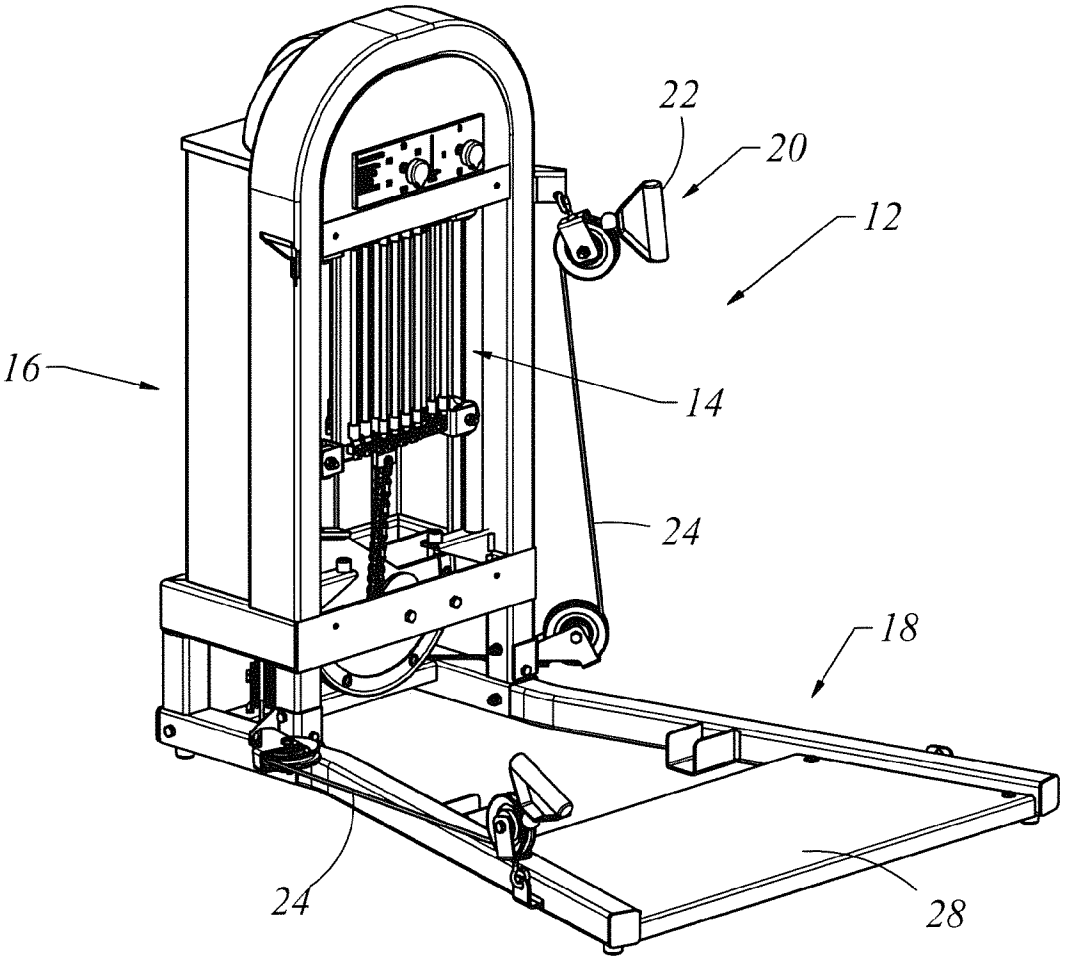
FIG. 2 is an isometric left side view of the device of FIG. 1 showing a cable attachment variation in more detail.

With reference to the illustrative drawings, and particularly to FIGS. 1 and 2, there is shown an exercise device 12 with a resistance system 14. The device 12 may include an upper frame 16 and a base frame 18 supporting the resistance system 14 therein. The device 12 may include a user interface 20. As is shown here, the user interface 20 may be a handle 22 with a cable 24 attached thereto. Pulley mounts 26 may be mounted to the base frame 18, or to the upper frame 16. FIG. 1 shows the device 12 from a right perspective where the left handle 22 is coupled to the base frame 18 and the right handle 22 is coupled to the upper frame 16. The right handle 22 may be more clearly seen in FIG. 2, as this is shown from the left perspective. The base frame 18 may also include a platform 28 suitable for supporting a user. In this manner, a user may stand on the platform 28, grasp one or more of the handles 22 and displace the handle 22 from its resting position, thus actuating the resistance system. The resistance system will be shown and described in greater detail further in this disclosure.

Figure 3:
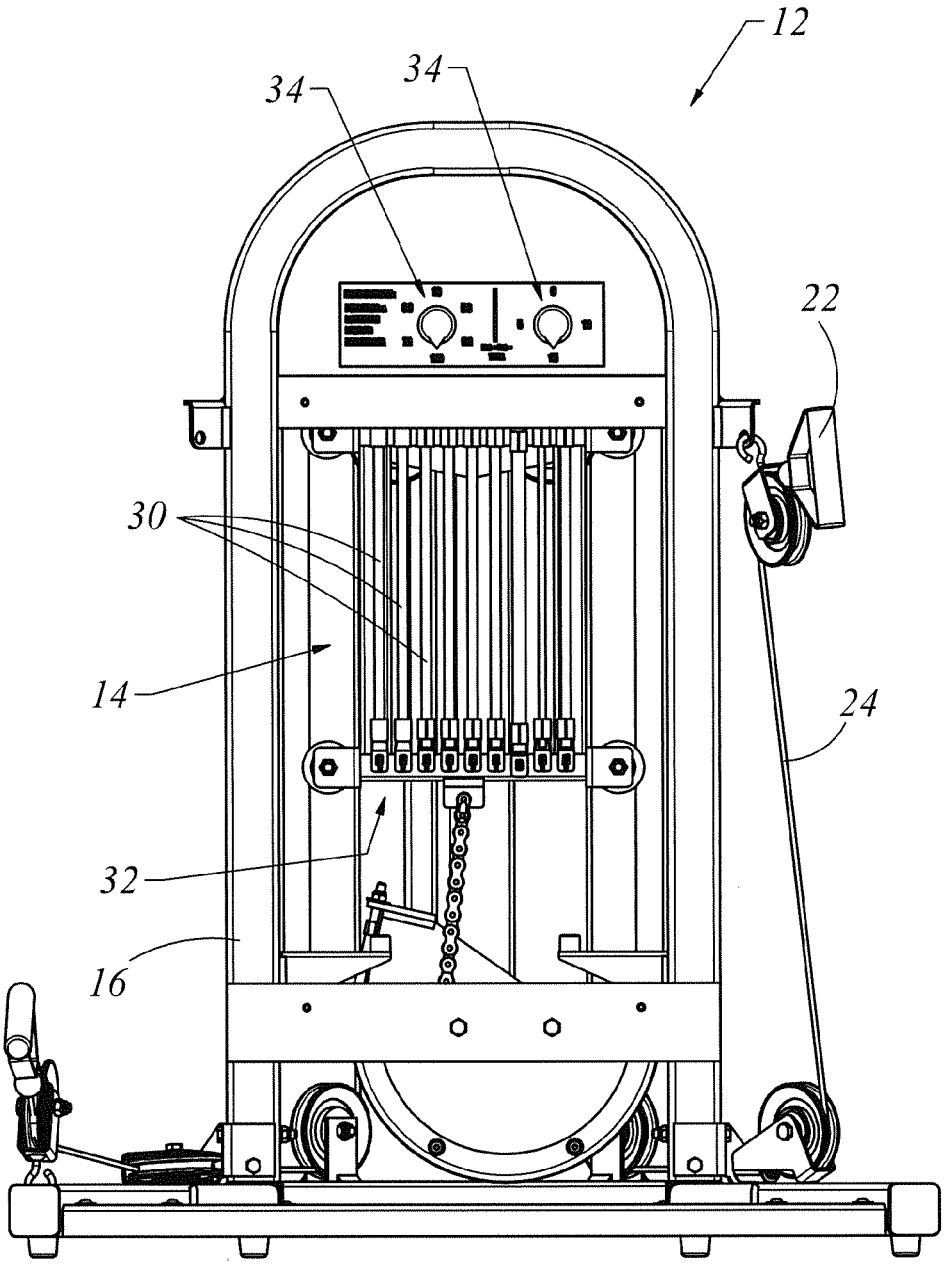
FIG. 3 is front view of the device of FIG. 1.

With reference to FIG. 3, the device 12 can be more clearly seen from the front view showing the resistance system 14. The resistance system 14 may include two or more resistance elements 30. The resistance elements 30 may be comprised of an elastic cord, a spring, pneumatics, other form of elastic resistance or hydraulics, etc. Weight plates, or other gravity based resistance, may also be used but are not shown in this embodiment of the invention. In this embodiment, the resistance elements 30 may be attached to the carriage 32, which is guided on the upper frame 16. The engagement or disengagement of specific resistance elements 30 may be altered by adjusting an engagement lock 34. In this embodiment there are two engagement locks 34, which are shown in more detail in the following figures.

Figure 5:
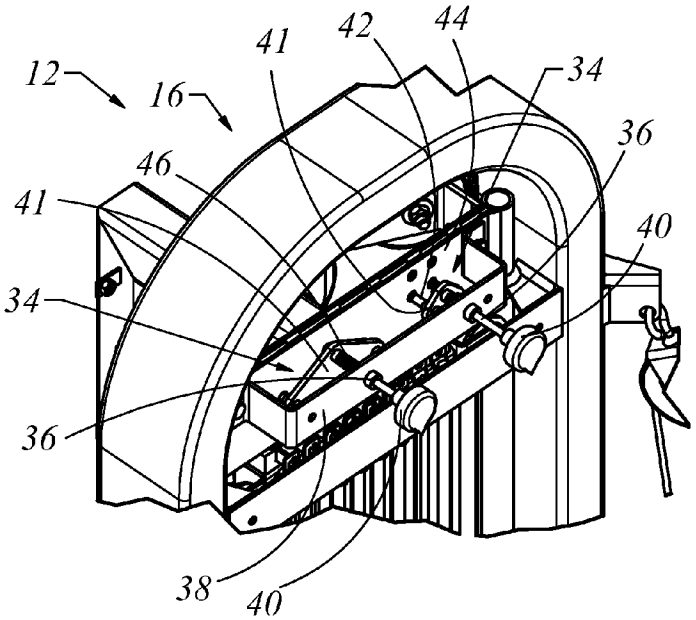
FIG. 5 is a detail view of the upper portion of the device of FIG. 4 cut along line 5-5.
Figure 4:
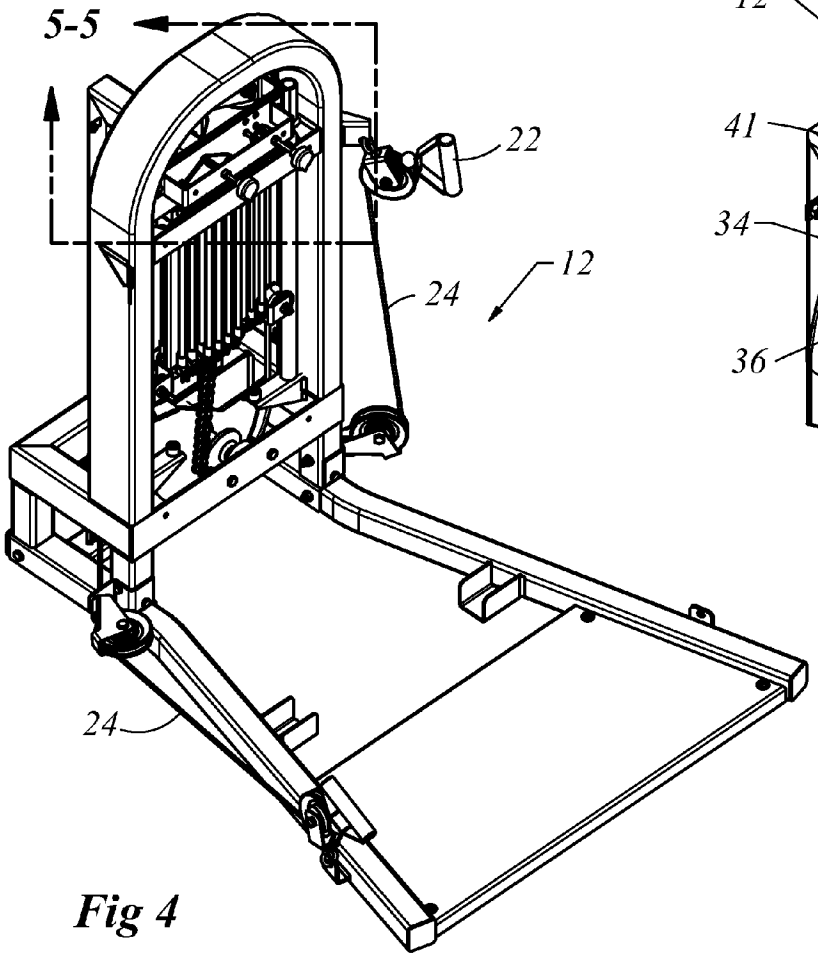
FIG. 4 is an upper left view of the device of FIG. 1.

In FIG. 4, a detail of the device 12 is shown with some of the housings removed to show more specific elements of the invention. FIG. 5 is a detail of the upper portion of the device 12 shown along line 5-5 in FIG. 4. In this view, the left engagement lock 34 is a different size and has a different number of pins compared to the right engagement lock 34. Each engagement lock 34 includes a main shaft 36 which is pivotally mounted to a support 38. The support 38 may be mounted to the upper frame 16. As shown in FIG. 5, the engagement lock 34 may include the knob 40 coupled to a first end of the main shaft 36 and a pin plate 41 coupled to a second end of the main shaft 36, as such, the pin plate 41 may thereby couple the main shaft 36 to the pins 42. This may allow the knob 40 which may be pulled out by the user, thereby disengaging the pins 42 from the back plate 44. When the pins 42 are disengaged from the back plate 44, the pins 42 are likewise disengaged from the resistance elements 30. In this view, the engagement lock 34 on the right is shown to be disengaged from the back plate 44 and the engagement lock 34 on the left is engaged with the back plate 44. A spring 46 may be used to bias the engagement locks 34 toward the back plate 44, thereby placing each engagement lock 34 in an engaged position when not being actuated by a user.

Figure 7:
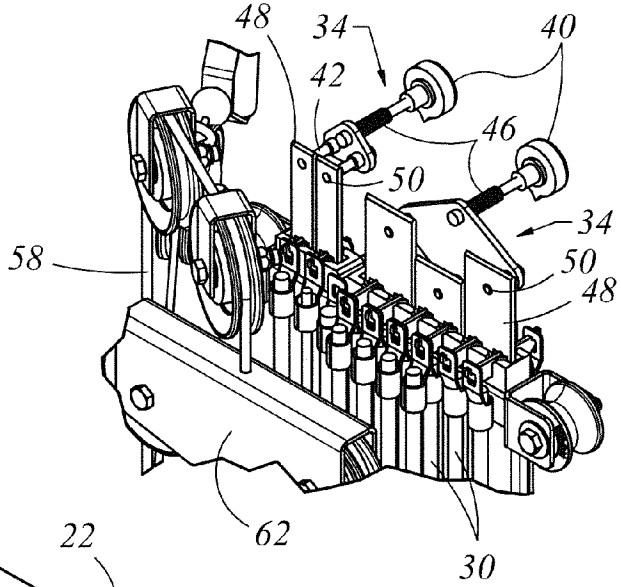
FIG. 7 is a detail view of the exercise device of FIG. 6 shown along line 7-7.
Figure 6:
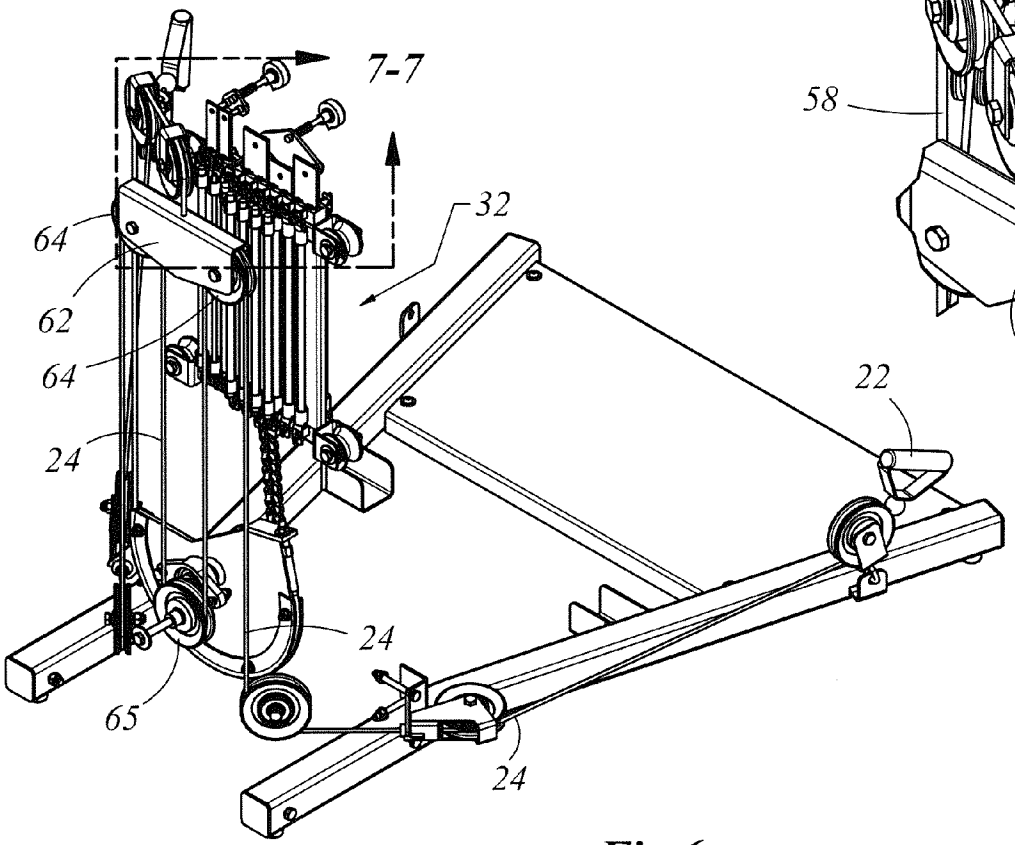
FIG. 6 is a left rear isometric view of the device of FIG. 1 with a portion of the frame removed.
Figure 8:
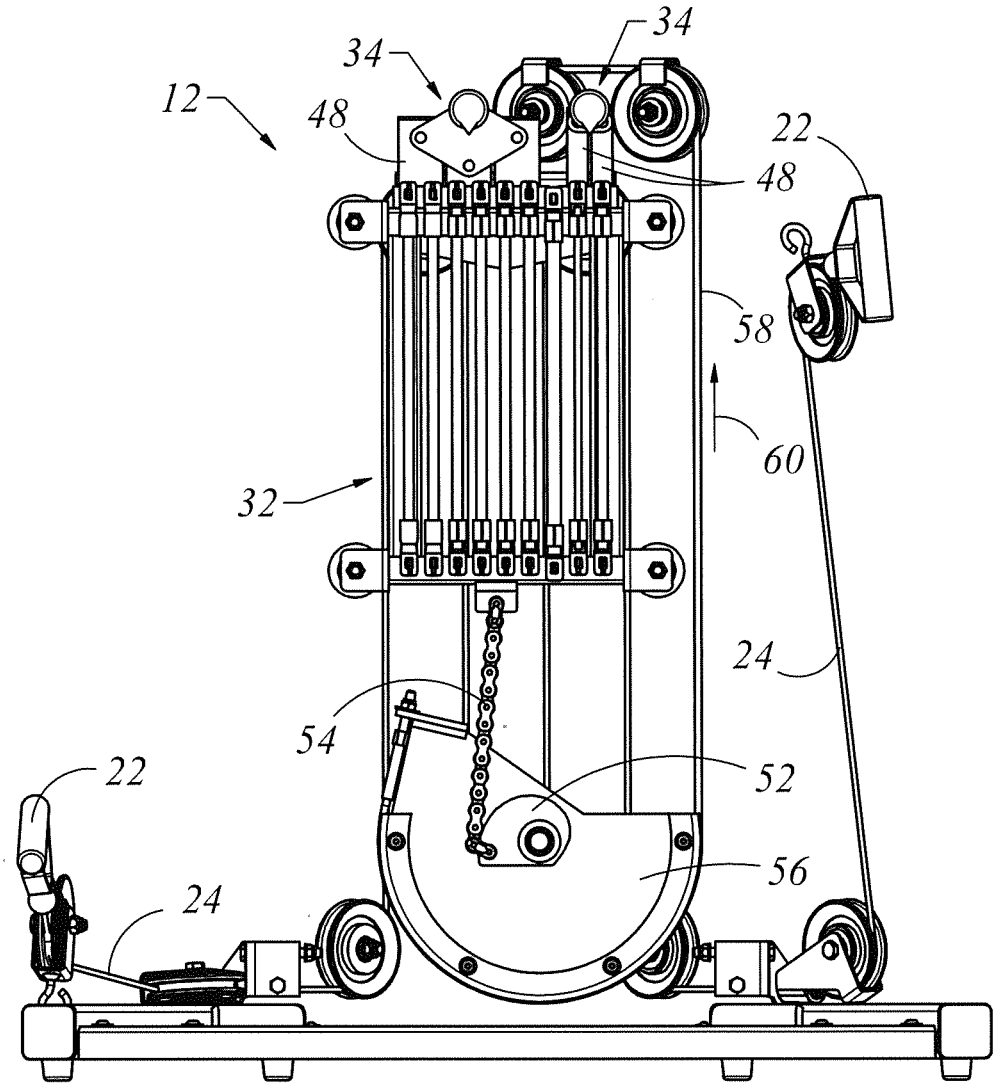
FIG. 8 is a front view of the exercise device of FIG. 6 shown with the frame removed.

For detail of the engagement and disengagement of the engagement locks 34 may be seen in FIGS. 6 through 8. Detail shown in FIG. 7 is shown along the cut line 7-7 of FIG. 6. Here is shown an example of how the pins 42 may engage the resistance elements 30. The resistance elements 30 may be connected to a cord plate 48. A cord plate 48 may support a single resistance element 30, a pair of two resistance elements 30, or multiple resistance elements 30. As is shown here, some cord plates 48 support four resistance elements 30 and some cord plates 48 support two resistance elements 30. A cord plate 48 may also be of a weighted element to act as its own gravity based resistance element, instead of being connected to the resistance elements 30. Each cord plate 48 includes a hole 50 adapted to receive the pin 42. When the pin 42 is received by the hole 50 in the cord plate 48, that cord plate 48 is supported relative to the upper frame 16, due to the engagement lock 34 which may be supported relative to the upper frame 16 as previously disclosed. The carriage 32 may be actuated away from any cord plates 48, which may be engaged to engagement lock 34. In an alternative embodiment, the carriage 32 and engagement locks 34 may be mounted 180 degrees clockwise. In this embodiment, the drive chain 54 would attach to the engagement locks 34 and the other end of the carriage 32 would be stationary. As the drive chain 54 is actuated, the engagement locks 34 would also move.

FIG. 8 shows a front view of the device 12 with the upper frame 16 removed. In this view the actuation of the carriage 32 may be illustrated. A drive cam 52 providing a variable moment arm to the carriage 32 as the drive cam 52 rotates relative to the frame may be coupled to the carriage 32 by the drive chain 54. The purpose of the variable moment arm of the drive cam 52 may be used to offset or change the linear increase in tension provided by an elastic element, which may comprise the resistance elements 30. The drive cam 52 may be secured to a drive wheel 56 which supports a drive cable 58. As the drive cable 58 is actuated in the direction of the arrow 60, the drive cable 58 unrolls from the drive wheel 56. The drive cam 52 rotates to take up links of the drive chain 54, thus displacing the carriage 32 toward the drive wheel 56. Any resistance elements 30 which are engaged to an engagement lock 34 will deform as the carriage 32 pulls away from those engagement locks 34. The deformation, of each resistance element 30, which is engaged with its relative engagement lock 34, provides a resistance to movement and generates tension in the drive cable 58. As is shown in FIGS. 6-7, the drive cable 58 is connected to a pulley block 62. The pulley block 62 allows for increased travel of the cable 24. In this embodiment of the invention, two idler pulleys 64 are housed within the pulley block 62. A stationary pulley 65 is mounted to the frame 16 (not shown here) also supports the continuous cable 24. Though not considered necessary to the novelty of the invention, this arrangement of the two floating idler pulleys 64 and one stationary pulley 65 provides a 4:1 displacement of the cable 24 relative to the movement of the pulley block 62 and therefore the drive cable 58. This is one of an infinite number of configurations of pulleys and wraps for the cable 24 that may be used to provide the desired travel and tension of the cable 24 for the user. It is understood there an infinite number of combinations that may be used that are inherently covered in the scope of this invention.

Figure 9:
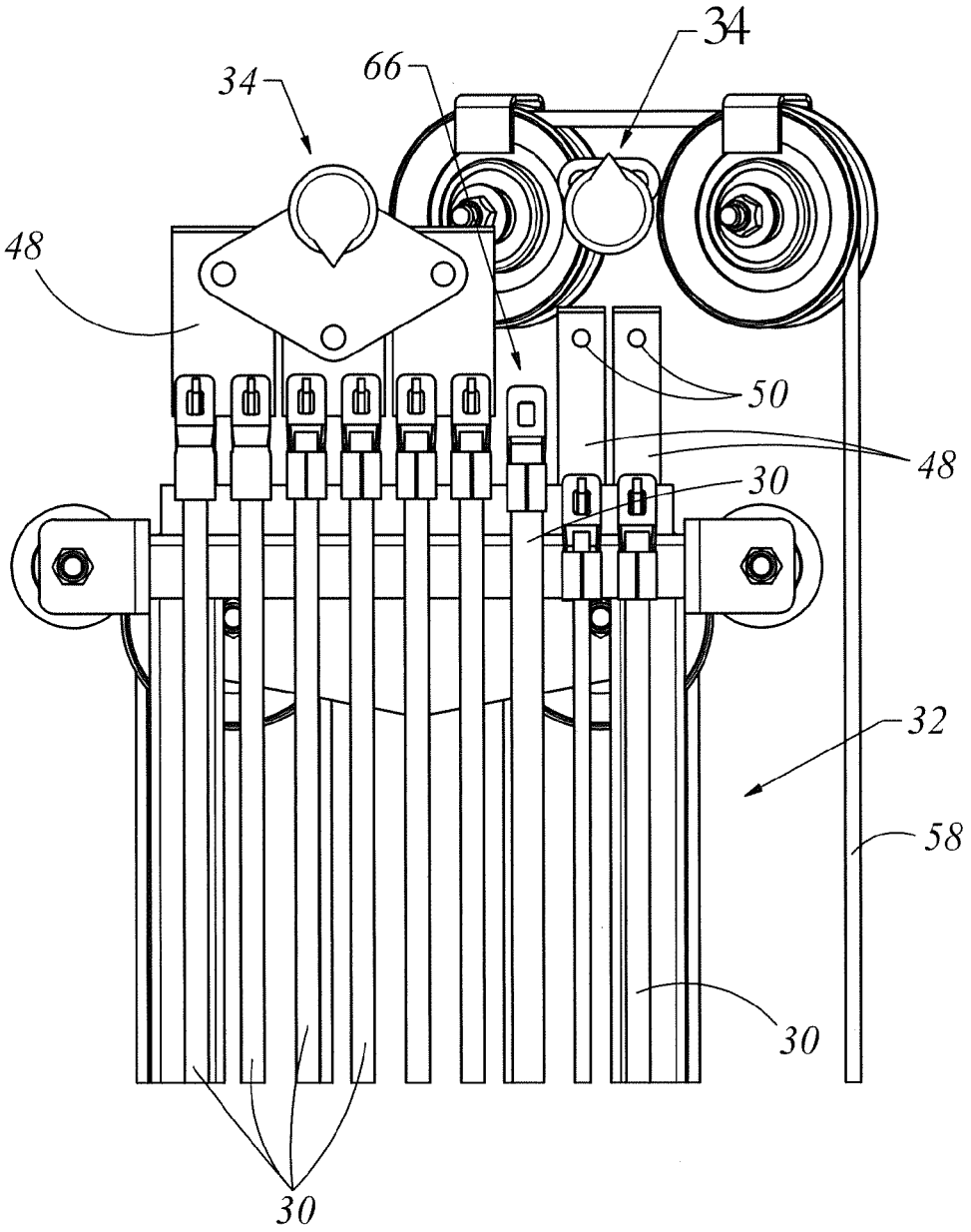
FIG. 9 is a front view of the upper portion of the resistance system of FIG. 8 with one group of cords engaged and a second ground disengaged and the carriage somewhat displaced.
Figure 10:
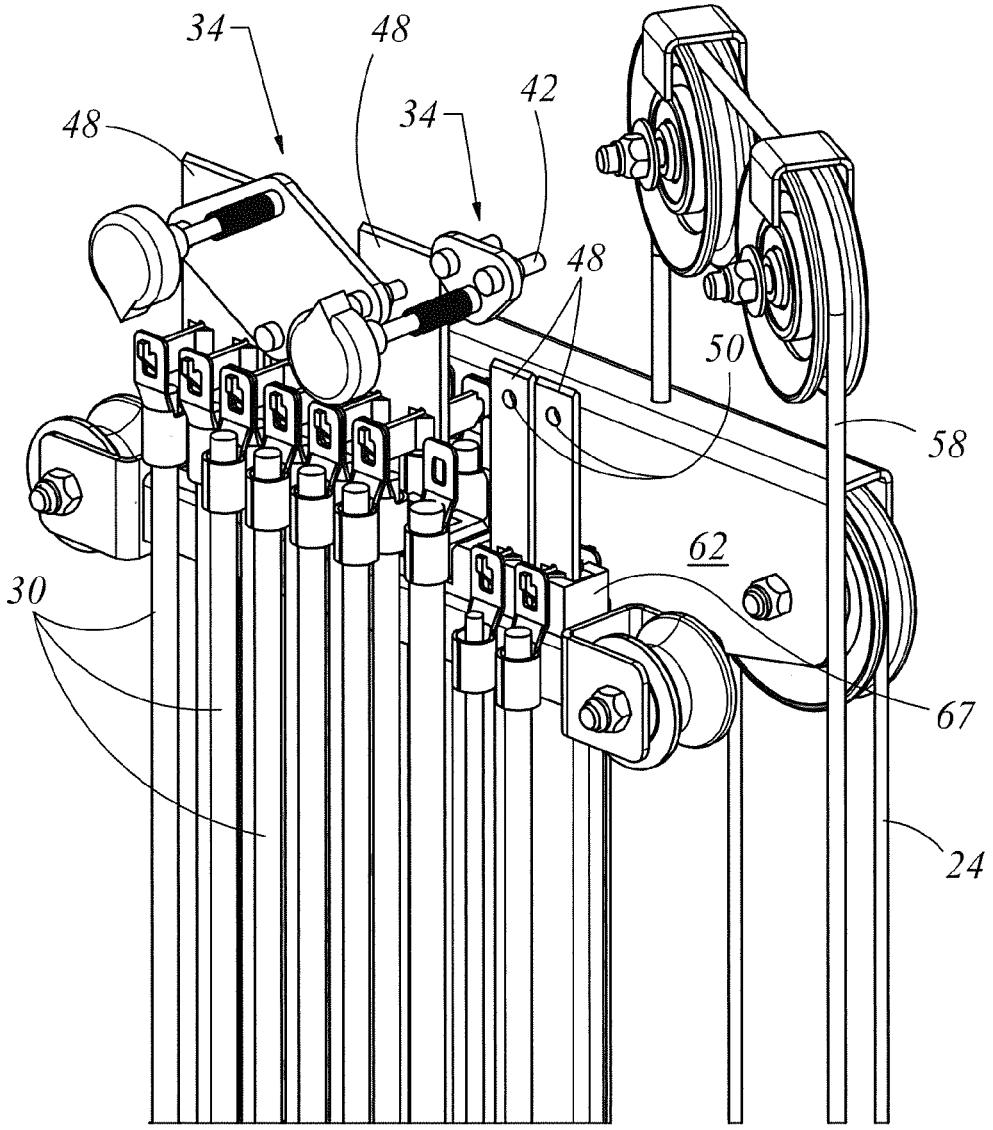
FIG. 10 is an isometric view of the resistance system of FIG. 9.

When the carriage 32 is displaced by providing sufficient tension in the drive cable 58 to overcome the resistance provided by the resistance elements 30, which are engaged with at least one of the engagement locks 34, the pulley block 62 will also be displaced from its starting position. What is shown in FIGS. 9-10 is an example of the left engagement lock 34 being engaged with all three of their respective cord plates 48 and therefore the resistance elements 30 attached to those cord plates 48. The two cord plates 48 on the right are disengaged from the engagement lock on the right, therefore the resistance elements 30 associated with the cord plates 48 on the right move with the carriage 32 as it is displaced. As such, the resistance elements 30 on the right do not deform and therefore do not add tension to the drive cable 58. In this example the engagement lock 34 on the left has engaged all three cord plates 48. If that engagement lock 34 was rotated 60° clockwise, only the left most two cord plates 48 would be engaged with the engagement lock 34. In a similar manner, if the left engagement lock 34 was rotated 120° clockwise, only the left most cord plate 48 would be engaged. The same is true for each 60° rotation of the left engagement lock 34 to engage any, all or none of the three left cord plates 48 when the carriage is in its top and resting position.

The right engagement lock 34 was rotated 180° such that the pins 42 do not engage the holes 50 in the cord plates 48 on the right when the carriage 32 was in its resting position. As with the engagement lock 34 on the left, the engagement lock 34 on the right may be rotated by 90° increments to engage either or both of their respective cord plates 48. In both engagement locks 34, the selective engagement of one, some, all or none of the respective cord plates 48 may be accomplished by providing the pins 42 be substantially radially equidistant from the main shaft 36. This substantially radial orientation may allow a pin 42 to index with any hole 50 in any of the cord plates 48 that are accessible by that engagement lock 34. The cord plates 48 which are not engaged into their respective engagement locks 34, may be supported by a plate guide 67. The plate guide 67 may provide guided support for the cord plates 48 disengaged from the engagement locks 34, thereby providing proper positioning relative to the engagement locks 34 when the carriage 32 returns to its top position.

A counterbalance 66 may be used to maintain continuous attachment to the carriage 32 and the upper frame 16. The counterbalance 66 may be a resistance element 30 similar to the others used in the system, or it may be comprised of a weight or other spring or any other system to bias the carriage 32 in its top and therefore resting position. This counterbalance 66 insures the weight of the carriage 32 does not prevent it from always recoiling to its top resting position, regardless if any of the engagement locks 34 are engaged with any of their respective cord plates 48 or not.

Figure 11:
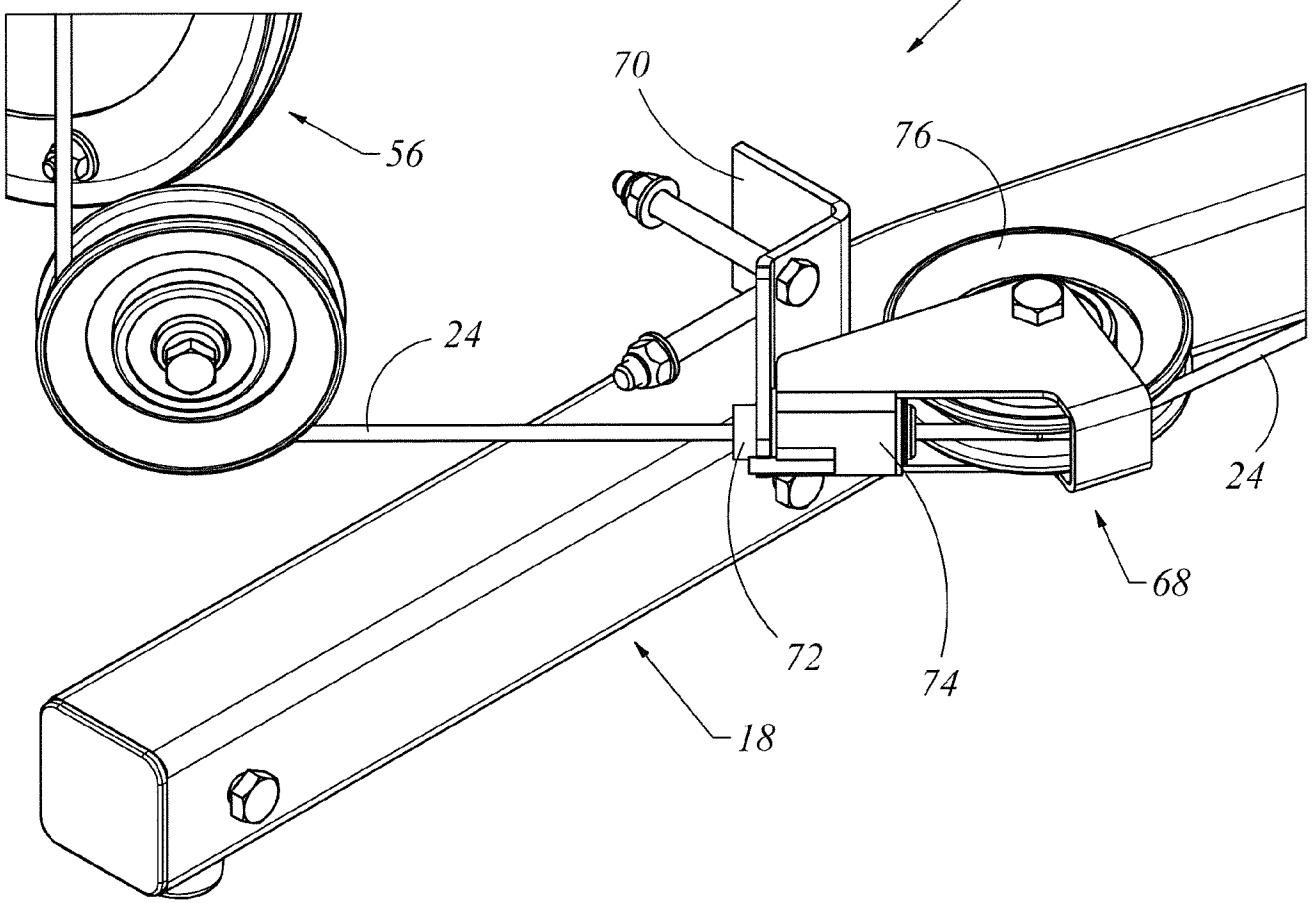
FIG. 11 is an isometric view of the rotational pulley on the left side of the lower frame of the device of FIG. 1.

In FIG. 11 a cropped view of the device 12 shown from a rear left perspective. Here illustrates the cable 24 as it may pass through a rotational pulley mount 68. The rotational pulley mount 68 may include a mounting bracket 70, which may be releasably fastened to the upper frame 16. The mounting bracket 70 may also include a mounting cylinder 72 that is adapted to receive a pulley cylinder 74. The cable 24 may pass through the mounting cylinder 72 and the pulley cylinder 74 and be received by a cable pulley 76. The pulley cylinder 74 may be allowed to rotate about the mounting cylinder 72, thereby creating a center of rotation of the axes of the pulley cylinder 74 and the mounting cylinder 72. The axes of the cable 24 may be collinear with axes of the pulley cylinder 74 in the mounting cylinder 72, thereby the rotational pulley mount 68 may be collinear with the axis of the cable 24. The rotational pulley mount 68 may allow the handle 22 or any other user interface 20 to self align about the axis of the cable 24 regardless of the position of the handle 22 or other user interface 20.

The foregoing detailed description of the present invention is provided for purposes of illustration, and it is not intended to be exhaustive or to limit the invention to the particular embodiment shown. The embodiments may provide different capabilities and benefits, depending on the configuration used to implement key features of the invention.

What is claimed is:

1. A resistance system for exercise, comprising:

a frame;

a first resistance element and a second resistance element located adjacent to the first resistance element, the first resistance element and the second resistance element being operationally unique from each other; and an engagement lock with a main shaft pivotally and slidably mounted to the frame, a pin plate coupled to the main shaft and at least two pins fixedly secured to the pin plate and each of the at least two pins positioned substantially radially equidistant from the main shaft, a pin of the at least two pins adapted to be selectively engaged with the first resistance element independent of the second resistance element.

2. The resistance system according to claim 1, further comprising a user interface adapted to enable a user to apply a force thereto, the user interface in communication with the first resistant element or the second resistant element, whereby when any of the first or second resistance elements is engaged by any of the at least two pins, the engaged resistance element provides resistance to movement of the user interface relative to the frame.

3. The resistance system according to claim 2, wherein the user interface is a handle with a cable attached to the handle.

4. The resistance system according to claim 1, wherein the first resistance element is comprised of an elastic cord coupled to a carriage, supported by the frame to allow for movement relative thereto.

5. The resistance system according to claim 4, wherein the carriage includes a plate guide adapted to support a resistance element not engaged by any of the at least two pins.

6. The resistance system according to claim 1, further comprising a drive cam coupled to a carriage, the carriage supporting the first resistance element, the drive cam pivotally coupled to the frame and providing a variable moment arm to the carriage as the cam rotates relative to the frame.

7. The resistance system according to claim 1, wherein the frame includes a base frame with pulley mounts and a platform adapted to support a user.

8. The resistance system according to claim 1, further comprising a rotational pulley mount including a pulley cylinder rotateably coupled to the frame about an axis of rotation defined by a center axis of the pulley cylinder and being substantially collinear with a longitudinal axis of a cable guided by a pulley mounted in the rotational pulley mount.

9. The resistance system according to claim 1, further comprising two operationally independent engagement locks each including a main shaft pivotally mounted to the frame and each including at least two pins positioned substantially radially equidistant from the main shaft.

10. An exercise system, comprising:

a frame, at least two resistance elements located adjacent to one another and operationally unique from each other; and an engagement system with a main shaft pivotally and slidably mounted to the frame, a pin plate coupled to the main shaft and at least two pins fixedly secured to the pin plate and each of the at least two pins positioned substantially radially equidistant from the main shaft, whereby each pin of the at least two pins are adapted to be selectively engaged with one resistance element of the at least two resistance elements independent of the second resistance element.

11. The exercise system according to claim 10, further comprising a user interface adapted to enable a user to apply a force thereto, the user interface in communication with one or more of the at least two resistance elements, whereby when any of the at least two resistance elements is engaged by any of the at least two pins, the engaged resistance element provides resistance to movement of the user interface relative to the frame.

12. The exercise system according to claim 11, wherein the user interface is a handle with a cable attached to the handle.

13. The exercise system according to claim 10, wherein the at least two resistance elements are comprised of elastic cords coupled to a carriage supported to allow for movement relative to the frame.

14. The exercise system according to claim 13, wherein the carriage includes a plate guide adapted to support any of the at least two resistance elements not engaged by any of the at least two pins.

15. The exercise system according to claim 10, further comprising a drive cam coupled to a carriage, the carriage supporting the at least two resistance elements, the drive cam pivotally coupled to the frame and providing a variable moment arm to the carriage as the cam rotates relative to the frame.

16. The exercise system according to claim 10, wherein the frame includes a base frame with pulley mounts and a platform adapted to support a user.

17. The exercise system according to claim 10, further comprising a rotational pulley mount including a pulley cylinder rotateably coupled to the frame about an axis of rotation defined by a center axis of the pulley cylinder and being substantially collinear with a longitudinal axis of a cable guided by a pulley mounted in the rotational pulley mount.

18. The exercise system according to claim 10, further comprising two operationally independent engagement systems each including a main shaft pivotally mounted to the frame and each including at least two pins positioned substantially radially equidistant from the main shaft.

19. A resistance system for exercise, comprising:

a frame;

a first resistance element and a second resistance element located adjacent to the first resistant element, the first resistance element and the second resistance element being operationally independent from each other; and an engagement lock with a main shaft pivotally and slidably coupled to the frame and at least two pins rigidly coupled to the main shaft and each of the at least two pins positioned substantially radially equidistant from the main shaft, whereby a first pin of the at least two pins may be disengaged from the first resistance element by displacement of the main shaft in a direction co-incident with a long axis of the main shaft, the engagement lock then rotated to align the pin with the second resistance element, the engagement lock moved along the long axis of the main shaft such that the pin may be engaged with the second resistance element independent of the first resistance element.

* * * * *